United States Patent [19]

Miller et al.

[11] 4,419,224

[45] * Dec. 6, 1983

[54] DESULFURIZATION OF HYDROCARBONS

[75] Inventors: J. Wayne Miller; John W. Ward, both of Yorba Linda, Calif.

[73] Assignee: Union Oil Company of California, Brea, Calif.

[ * ] Notice: The portion of the term of this patent subsequent to Jun. 22, 1999 has been disclaimed.

[21] Appl. No.: 390,676

[22] Filed: Jun. 21, 1982

Related U.S. Application Data

[63] Continuation of Ser. No. 211,376, Nov. 28, 1980, Pat. No. 4,336,130.

[51] Int. Cl.[3] ..... C10G 29/04; C10G 29/06

[52] U.S. Cl. ..... 208/244; 208/91; 585/850

[58] Field of Search ..... 208/243, 244, 88, 91; 585/850

[56] References Cited

U.S. PATENT DOCUMENTS

| | | | |
|---|---|---|---|
| 2,417,041 | 3/1947 | Ayers et al. | 208/244 |
| 2,559,323 | 7/1951 | Spillane | 208/244 |
| 2,615,831 | 10/1952 | Bishop et al. | 208/244 |
| 2,740,747 | 4/1956 | Sweetser et al. | 208/189 X |
| 2,755,226 | 7/1956 | Annable et al. | 208/248 X |
| 2,756,182 | 6/1956 | Kimberlin, Jr. et al. | 208/244 |
| 2,769,759 | 11/1956 | Annable et al. | 208/189 |
| 2,876,196 | 3/1959 | Thorn | 208/244 |
| 2,897,142 | 7/1959 | Jacobs et al. | 208/212 |
| 2,951,034 | 8/1960 | Stuart | 208/244 |
| 3,349,027 | 10/1967 | Carr et al. | 208/244 |
| 3,413,216 | 11/1968 | Doumani | 208/216 |
| 3,485,746 | 12/1969 | Setzer et al. | 208/244 |
| 3,485,884 | 12/1969 | Davis | 260/674 |
| 3,884,797 | 5/1975 | Alley, Jr. et al. | 208/89 |
| 3,898,153 | 8/1975 | Louder et al. | 208/89 |
| 3,923,646 | 12/1975 | Hilfman | 208/216 |
| 3,933,623 | 1/1976 | Durkin et al. | 208/216 |
| 3,996,130 | 12/1976 | Nametkin et al. | 208/243 |
| 4,225,418 | 9/1980 | Hilfman | 208/111 |

*Primary Examiner*—Delbert E. Gantz
*Assistant Examiner*—O. Chaudhuri
*Attorney, Agent, or Firm*—Alan H. Thompson; Gregory F. Wirzbicki; Dean Sandford

[57] ABSTRACT

A hydrocarbon feedstock containing organo-sulfur compounds, such as a naphtha containing mercaptans, is desulfurized by contact, under non-hydrogenative conditions, with a reduced catalytic absorbent comprising one or more nickel components and one or more platinum group metal promoters composited with a porous refractory oxide.

14 Claims, No Drawings

DESULFURIZATION OF HYDROCARBONS

This application is a continuation of application Ser. No. 211,376, filed Nov. 28, 1980 now U.S. Pat. No. 4,336,130.

BACKGROUND OF THE INVENTION

This invention relates to the desulfurization of hydrocarbon feedstocks, and most particularly to the desulfurization of reformer feedstocks by contact with a catalytic absorbent.

Petroleum refining processes such as catalytic reforming are utilized for such purposes as hydrogenation and dehydrogenation, cyclization and dehydrocyclization, and isomerization and dehydroisomerization of selected hydrocarbons. Catalytic reforming processes play an integral role in upgrading straight run or cracked naphtha feedstocks, as by increasing the octane number of the gasoline fraction contained in such feedstocks. In a typical reforming process treating a straight run naphtha or cracked naphtha, the feedstock is upgraded by contact with a catalyst comprising a noble metal on alumina. Conditions utilized in reforming processes vary depending upon such factors as the type of feed processed and the desired increase in octane level.

To achieve maximum run lengths and increase process efficiency, it is generally recognized that the sulfur content of the feedstock must be minimized. Reforming catalysts, and particularly those comprising platinum, and most particularly comprising platinum and rhenium, deactivate rapidly in the presence of sulfur compounds, and as a result, it is necessary to reduce the sulfur content of reformer feedstocks as low as possible. Preferably, feedstocks contacted with reforming catalysts are desulfurized to contain less than 0.1 ppm by weight sulfur.

A common method of treating reformer feeds to reduce the sulfur content is by hydrodesulfurization wherein a naphtha or other feedstock is contacted with a sulfur-tolerant hydrogenation catalyst in the presence of hydrogen. The sulfur in the feedstock is converted by hydrogenation and cracking to hydrogen sulfide, which may be separated from the naphtha by conventional means prior to reforming. Although good sulfur removal may be achieved by hydrodesulfurization units operating under severe conditions, the efficiency of such processes is ultimately limited by equilibrium and/or kinetic considerations. In many instances, it is not possible to obtain hydrodesulfurized products containing less than 0.1 ppmw sulfur as desired in most reforming operations. Furthermore, it is impossible to guard against upsets in the hydrodesulfurization unit which can result in high levels of organo-sulfur compounds remaining in the reformer feedstock.

In addition to hydrodesulfurization, there are other methods employing catalytically active materials for removing sulfur from hydrocarbons. Such methods reduce the sulfur content of the hydrocarbon by "absorbing" sulfur therefrom and generally employ a catalytically active absorbent material under non-hydrogenative conditions. Usually, the absorbent material contains a metal component, such as nickel, copper, or silver, and the feedstocks generally treated are reformer feedstocks, particularly naphthas. Typical of such processes include that disclosed in U.S. Pat. No. 2,767,759 to Annable wherein a bed of nickel molybdate pellets is utilized to reduce the sulfur content of naphthas. Similarly, in U.S. Pat. No. 4,704,947 to Jacobson et al., the use of copper components supported on conventional carriers is disclosed for reducing the thiol content of naphthas by absorption. In addition, Thorn in U.S. Pat. No. 2,876,196 describes a method for desulfurizing hydrocarbon feedstocks by contact with catalytic particles comprising platinum supported on a suitable carrier, and sulfur-contaminated aromatic hydrocarbons have been purified with supported nickel components under non-hydrogenative conditions as taught by Davis in U.S. Pat. No. 3,485,884.

One object of the present invention is to provide an improved process for removing sulfur from naphthas and other feedstocks under non-hydrogenative conditions with a catalytic material useful for absorbing sulfur compounds from the feed. A specific object is to provide a process useful for lowering the sulfur content of reformer feeds to below 0.1 ppm by weight. A further object is to enhance the sulfur absorption capacity of nickel-containing absorbents by the addition of platinum group metal promoters. Other objects and advantages will be more apparent in view of the following detailed description.

SUMMARY OF THE INVENTION

In accordance with the process of the present invention, liquid hydrocarbons containing organo-sulfur compounds, and particularly reformer feedstocks containing at least 0.1 ppmw sulfur, are desulfurized by contact at elevated temperatures under non-hydrogenative conditions with a reduced catalytic absorbent comprising one or more nickel components and one or more platinum group metal promoters composited with a porous refractory oxide. During contact with the sulfur-containing hydrocarbon, the reduced catalytic absorbent increases in sulfur content, and the concentration of organo-sulfur compounds in the hydrocarbon is lowered.

It will be understood that, although the term "catalytic absorbent" or "catalytic sorbent" is used herein to describe the material with which the feedstocks are contacted, and the term "absorbed" is used to describe the mechanism by which the sulfur is held thereon, the invention embraces whatever mechanism, including adsorption, absorption, deposition, chemical reactions, etc., or some combinations of such mechanisms, by which the sulfur is removed from the hydrocarbon feedstock and retained by the catalytic absorbent. Also, the terms "sulfur" and "organo-sulfur compounds" are used interchangeably herein and are intended to include sulfur in whatever form, elemental or combined, it may be present. Also, all feedstock and product oil sulfur concentrations are herein calculated as elemental sulfur.

DETAILED DESCRIPTION OF THE INVENTION

Feedstocks commonly treated by the method described herein broadly include all liquid hydrocarbon containing organo-sulfur components, particularly those in which the organo-sulfurcompounds comprise a substantial proportion of mercaptans. The present invention is most suitable for treating reformer feedstocks which are to be subjected to catalytic reforming over a platinum or platinum-rhenium reforming catalyst or other metal-containing reforming catalyst that deactivates upon contact with sulfur. Such feedstocks usually contain above about 0.1 ppmw sulfur and boil in the range of 150° to 450° F. The preferred reformer feedstock is a naphtha hydrocrackate containing organo-sulfur compounds essentially completely in the form of mercaptans, and the most preferred feedstock is a naphtha hydrocrackate containing between 0.1 and 20 ppmw sulfur in mercaptan form.

The removal of sulfur from the hydrocarbon feedstock is herein carried out by contact at elevated temperatures with a reduced catalytic absorbent comprising one or more nickel components, usually in a proportion between about 5 and 50% by weight, calculated as NiO, and one or more platinum group metal promoters composited with a porous refractory oxide. The platinum group metals for use herein are selected from the group consisting of ruthenium, rhodium, palladium, osmium, iridium, and platinum. Preferred catalytic absorbents comprise nickel in combination with platinum and/or palladium components composited with a refractory oxide. Platinum in combination with nickel composited on a refractory oxide is the most preferred catalytic absorbent. The nickel and platinum group metal promoters are usually present in the catalytic absorbent in an atomic ratio less than 5000 to 1, preferably between about 50 to 1 and 500 to 1, nickel to platinum group metal promoter. If desired, other metals, such as molybdenum or tungsten, may also be present in the catalytic absorbent.

Numerous porous refractory oxides may be utilized to support the metal components. Representatives of such support include alumina, silica, silica-alumina, zirconia, silica-zirconia, titania, and magnesia, and combinations thereof. However, the preferred support is alumina, most preferably gamma alumina having a surface area above about 100 $m^2/gm$, with the most preferred surface areas being between 150 and 400 $m^2/gm$. The refractory oxide usually comprises at least about 25 weight percent and preferably at least about 35 weight percent of the catalytic absorbent.

Several methods are known in the art by which the nickel and platinum group metal promoter can be composited with the preferred alumina support. One such method, for example, involves impregnating alumina pellets or extrudates with an aqueous solution of soluble nickel and platinum group metal promoter salts. Impregnation is usually accomplished in sequential steps, as by first contacting alumina pellets or extrudates with an aqueous solution, occasionally an aqueous ammoniacal solution, of a soluble nickel salt followed by calcination and then contacting the resulting composite with a solution of one or more platinum group metal promoter salts.

Another method by which the nickel and platinum group metal promoters may be composited with alumina or other refractory oxide is comulling. Alumina may be comulled, for example, with a solution of nickel and a metal promoter salt until an extrudable paste is formed. Alternatively, alumina may be comulled with a nickel salt and a metal promoter salt, such as nickel carbonate and chloroplatinic acid in the presence of sufficient water to create a paste extrudable through a die. This latter comulling method is especially preferred when a nickel carbonate is utilized as the nickel salt.

Composites of the nickel salt, metal promoter salt, and refractory oxide prepared by one of the foregoing methods or an obvious equivalent are then calcined in air, usually at temperatures between about 500° and 1200° F., preferably between 500° and 900° F.

In order to product a catalytic absorbent for use herein, it is necessary that the calcined composite be reduced. It has been found that the removal of sulfur from hydrocarbon feedstocks is difficult to achieve so long as the catalytic absorbent remains in its calcined, oxidized form. It is therefore a critical feature of the invention that the absorbent be reduced, as by contact at elevated temperatures, usually above 300° F., with a reducing agent, such as carbon monoxide or hydrogen, with hydrogen being highly preferred. One preferred method involves contacting one volume of the catalyst with fifty or more volumes of hydrogen at a temperature between about 500° F. and 900° F., more preferably between 550° F. and 750° F., over a time period of one to eight hours.

One of the discoveries in the invention is that the presence of a platinum group metal, and platinum in particular, greatly increases the conversion of nickel components on the absorbent during the reduction step to other nickel components more active for absorbing sulfur. For example, as will be shown hereinafter in Example I, reduction at 650° F. of nickel-platinum or nickel-palladium absorbents provides sulfur-absorption capacities equal to, or greater than that of a nickel catalyst reduced at the thermodynamically more favorable reduction temperature of 800° F.

In accordance with the invention, the feedstock to be desulfurized is contacted with the reduced catalytic absorbent in a suitable reactor vessel under conditions of elevated temperature, preferably between 100° and 600° F., and most preferably between 200° and 400° F. Preferably, contact of the reduced absorbent with the feedstock is performed in the absence of hydrogen. If desired, however, hydrogen may be present, but only in amounts or under conditions that prevent essentially any hydrogenation of the organo-sulfur components in the feedstock.

An unusual feature of this invention is that, in comparison to catalytic absorbents containing nickel components but no platinum group metals, the reduced catalytic absorbent of the invention is substantially more active for removing sulfur compounds from a hydrocarbon feedstock. The platinum group metal, therefore, substantially enhances the activity of reduced nickel components for absorbing sulfur compounds. In comparison to a similarly reduced catalytic absorbent containing no platinum group metal, the catalytic absorbent of the invention exhibits at least twice, usually at least three times, the capacity for absorbing sulfur as the comparison absorbent. This result is believed due to a catalytic promoting effect platinum group metals have for converting nickel oxides during the reduction step to components having substantially more activity for absorbing sulfur. Thus, when reformer feeds and the like are treated for sulfur removal, the catalytic absorbent of the invention, due to its increased activity and capacity for absorbing sulfur, is useful for maintaining a low sulfur concentration in the product, usually below 0.1 ppmw, for a time period substantially in excess of that possible with similarly prepared catalytic absorbents but containing no platinum group metals.

The following Examples are provided to illustrate the process of the invention and to provide evidence of the superior properties of the catalytic absorbent of the invention. The Examples are not provided to limit the scope of the invention which is defined by the claims.

EXAMPLE I

Five differently prepared catalytic absorbents were tested to determine how effectively each would perform as a sulfur absorbent. The five catalytic absorbents were prepared as follows:

(A) 42 wt.% NiO, 8 wt.% $MoO_3$, on alumina

This catalytic absorbent was prepared in a manner similar to that described for the preparation of the catalyst in Example II of U.S. Pat. No. 4,046,674 to Young, herein incorporated by reference in its entirety. However, in the present preparation, after prescreening all of the inorganic powders, all the dry components were mulled together for 30 minutes followed by addition of 0.5 N $HNO_3$ with continued mulling for an additional 90 minutes. After sufficient water was added to form an extrudable paste, the paste was passed through a die having clover leaf openings of 0.067 inch overall cross-sectional width. After steam drying at 300° F., the extrudates were then calcined in air for 1 hour at 850° F. Instead of presulfiding as in Example II of the aforementioned patent, the catalytic absorbent was reduced by contacting hydrogen at a rate of 0.3 SCFH at 650° F. for 1 hour with the catalytic absorbent.

(B) 42 wt.% NiO, 8 wt.% $MoO_3$, on alumina

This catalytic absorbent was prepared according to the method of catalytic absorbent (A) except the reduction was done at 800° F.

(C) 42 wt.% NiO, 8 wt.% $MoO_3$, 0.5% Pt on alumina

This catalytic absorbent was prepared according to the method of catalytic absorbent (A) except the calcined extrudates were calcined a second time for 1 hour at 850° F. after impregnation with sufficient chloroplatinic acid $H_2PtCl_6$ to produce an extrudate containing 0.5 wt.% platinum. The calcined composite was then reduced in the manner used to prepare catalytic absorbent (A). The final absorbent contained nickel and platinum in an atomic ratio, nickel to platinum, of 233 to 1.

(D) 42 wt.% NiO, 8 wt.% $MoO_3$, 0.05 wt.% Pt on alumina

This catalytic absorbent was prepared according to the method of catalytic absorbent (C) except with sufficient chloroplatinic acid $H_2PtCl_6$ to produce an extrudate containing 0.05 wt.% platinum. The final absorbent contained nickel and platinum in an atomic ratio, Ni to Pt, of 2330 to 1.

(E) 42 wt.% NiO, 8 wt.% $MoO_3$, 0.27% Pd on alumina

This catalytic absorbent was prepared according to the method of catalytic absorbent (C) except with sufficient chloropalladinic acid, $H_2PdCl_6$ to produce an extrudate containing 0.27 wt.% palladium. The final catalyst contained nickel and palladium in an atomic ratio of, Ni to Pd, of 235 to 1.

Each of the foregoing catalytic absorbents was utilized as a sulfur absorbent in the following manner: Twenty-three grams of absorbent was placed in a tubular reactor of suitable size, and a reformer feedstock boiling, in the range between 200° F. and 350° F., spiked with n-butyl mercaptan to contain 3,700 ppmw sulfur, was passed through the reactor at a LHSV of 4.0 and a mass rate of 235 lbs/hr/ft$^2$. Other operating conditions were: a temperature of 300° F. and a pressure of 50 psig.

Samples of the product were removed from the reactor at 30 minute intervals over a 2 hour time period, and the samples were then analyzed by appropriate X-ray fluorescence methods to determine their sulfur concentrations. The data so obtained are tabulated in Table I.

TABLE I

| | Catalytic Absorbent (A) | Catalytic Absorbent (B) | Catalytic Absorbent (C) | Catalytic Absorbent (D) | Catalytic Absorbent (E) |
|---|---|---|---|---|---|
| Nickel to Pt. Group Atomic Ratio | 0 | 0 | 233/1 | 2330/1 | 235/1 |
| Reduction Temperature, °F. | 650 | 800 | 650 | 650 | 650 |
| Absorbent Contact Time, Hrs. | Effluent Sulfur Concentration (ppmw) | | | | |
| .5 | <5 | <5 | <5 | <5 | <5 |
| 1.0 | 528 | <5 | <5 | <5 | <5 |
| 1.5 | 672 | 587 | <5 | 146 | 696 |
| 2.0 | 768 | 670 | 176 | 746 | 942 |

As shown, of those absorbents reduced at the same temperature, i.e., 650° F., the absorbents containing platinum or palladium all exhibit better absorption capacity than the absorbent containing no platinum or palladium. In particular, catalytic absorbent (C) exhibits the best absorption capacity, maintaining sulfur concentrations of less than 5 ppmw for a time period three times as long as absorbent (A).

Also, of those absorbents reduced at the same temperature, i.e., 650° F., absorbents (C), (D) and (E) containing platinum or palladium all exhibit better or essentially equivalent sulfur-absorption capacity than absorbent (B), which was reduced at the higher, more favorable temperature of 800° F. Thus, absorbents prepared in accordance with the invention require less favorable reduction conditions (i.e., 650° F.) to produce at least the same sulfur-absorption capacity as a comparison absorbent containing no platinum group metal.

EXAMPLE II

A reformer feedstock similar to that of Example I was spiked with n-butyl mercaptan to contain 825 ppmw sulfur and passed through a reactor containing 37 grams of a catalytic absorbent prepared in accordance with the invention. The experiment was then repeated using a comparison catalyst. The operating conditions were: a temperature at 300° F., a liquid hourly space velocity (LHSV) of 5.0, a pressure of 50 psig, and a mass velocity of 235 lbs/hr/ft$^2$. The two catalytic absorbents were similar to absorbents (A) and (C) of Example I, except the absorbents were reduced by passing hydrogen at a rate of 3 SCFH at 650° F. for 6 hours through a bed of the absorbent particles.

Samples of the product from the reactor were collected at about 4 hour intervals over a time period of 54 hours and analyzed for their sulfur content. The data so obtained are tabulated in Table II.

TABLE II

| Time, Hrs. | Effluent Sulfur Concentration (ppmw) Catalytic Absorbent (A) Ni | Catalytic Absorbent (C) Ni/Pt (233 to 1 atomic ratio) |
|---|---|---|
| 2 | 8 | <5 |
| 6 | 16 | <5 |
| 14 | 132 | <5 |
| 18 | 215 | <5 |
| 22 | 528 | 25 |
| 26 | 676 | 82 |
| 30 | 717 | 99 |
| 34 | 759 | 165 |
| 38 | N.D.* | 404 |
| 42 | N.D. | 495 |
| 46 | N.D. | 546 |
| 50 | N.D. | 561 |
| 54 | N.D. | 569 |

*N.D. = Not Determined

The effluent from the reactor when catalytic absorbent (C) was utilized exhibited detectable sulfur after 22 hours, while the effluent treated by contact with catalytic absorbent (A) exhibited detectable sulfur of approximately equivalent concentrations after only 2 hours. Thus, the results of the experiment indicate that adding as little as 0.5 wt.% platinum to a nickel catalytic absorbent substantially increases the capacity of the absorbent for removing sulfur in comparison to a similar absorbent containing no platinum.

Although the invention has been described in conjunction with examples thereof, including comparative examples, many modifications, variations, and alternatives of the invention as described will be apparent to those skilled in the art. Accordingly, it is intended to embrace within the invention all such variations, modifications, and alternatives as fall within the spirit and scope of the appended claims.

We claim:

1. A process comprising (a) contacting a hydrocarbon feedstock containing organo-sulfur compounds with a reduced catalytic absorbent comprising one or more nickel components and one or more platinum group metal promoters composited with a porous refractory oxide, said contacting being under substantially non-hydrogenative conditions including an elevated temperature such that a substantial proportion of said organo-sulfur compounds is removed from said feedstock and said catalytic absorbent increases in sulfur content; and (b) recovering a hydrocarbon product stream containing less organo-sulfur compounds than are contained in said feedstock.

2. A process as defined in claim 1 wherein said feedstock is a reformer feed containing more than about 0.1 ppmw sulfur and said product stream contains less than 0.1 ppmw sulfur.

3. A process as defined in claim 1 wherein said catalytic absorbent comprises between about 5 and 50 wt.% nickel components, calculated as NiO.

4. A process as defined in claim 3 wherein said catalytic absorbent comprises nickel and one or more platinum group metals in an atomic ratio between 1:1 to 5000:1, nickel to platinum group metals.

5. A process as defined in claim 4 wherein said contacting is accomplished in the absence of hydrogen.

6. A process as defined in claim 5 wherein said organo-sulfur compounds comprise a substantial proportion of mercaptans.

7. The process as defined in claim 1 or 3 wherein said catalytic absorbent is reduced with hydrogen.

8. The process as defined in claim 1 wherein said platinum group metal promoters are selected from the group consisting of ruthenium, rhodium, palladium, osmium, iridium and platinum.

9. The process defined in claim 1 wherein said platinum group metal promoters comprise platinum or palladium.

10. A process comprising (a) contacting a reformer feedstock containing mercaptans with a catalytic absorbent comprising between about 5 and 50 percent by weight of nickel components, calculated as NiO, and one or more platinum group metal promoters selected from the group consisting of ruthenium, rhodium, palladium, osmium, iridium and platinum, composited with a porous refractory oxide, said catalytic absorbent having been reduced by hydrogen at an elevated temperature, said contacting being under substantially non-hydrogenative conditions including a temperature between 100° F. and 600° F. such that a substantial proportion of said mercaptans is removed from said feedstock; and (b) recovering a product stream containing less mercaptans than are contained in said feedstock.

11. A process as defined in claim 8 wherein said feedstock contains more than about 0.1 ppmw sulfur and said product stream contains less than 0.1 ppmw sulfur.

12. The process as defined in claim 9 wherein said catalytic absorbent comprises nickel and one or more platinum group metals in an atomic ratio between 1:1 to 5000:1, nickel to platinum group metal.

13. The process as defined in claim 10 wherein said contacting is accomplished in the absence of hydrogen.

14. A process comprising (a) contacting, in the absence of hydrogen and at a temperature in the range of about 200° F. to 400° F., a reformer feedstock containing more than 0.1 ppmw sulfur comprising a substantial proportion of mercaptans with a catalytic absorbent comprising between about 5 and 50 weight percent of nickel components, calculated as NiO, and one or more platinum metal promoters in an atomic ratio between about 1:1 to 5000:1, nickel to platinum metal, composited with a porous refractory oxide consisting essentially of alumina, said catalytic absorbent having been reduced with hydrogen at a temperature between 500° F. and 900° F., such that a substantial proportion of said mercaptans is removed from said feedstock while said catalytic absorbent increases in sulfur content; and (b) recovering a product stream containing less than about 0.1 ppmw sulfur.

* * * * *